US008079094B2

(12) United States Patent
DiPano

(10) Patent No.: US 8,079,094 B2
(45) Date of Patent: Dec. 20, 2011

(54) PUBLIC RESTROOM TOILET SEAT SANITIZING APPARATUS

(76) Inventor: Jeffrey D. DiPano, Lambertville, NJ (US)

( * ) Notice: Subject to any disclaimer, the term of this patent is extended or adjusted under 35 U.S.C. 154(b) by 1106 days.

(21) Appl. No.: 11/907,009

(22) Filed: Oct. 9, 2007

(65) Prior Publication Data

US 2008/0028506 A1 Feb. 7, 2008

Related U.S. Application Data

(63) Continuation-in-part of application No. 11/030,225, filed on Jan. 7, 2005, now abandoned.

(51) Int. Cl.
*A47K 13/00* (2006.01)

(52) U.S. Cl. ..... 4/233; 4/229; 4/661

(58) Field of Classification Search ..... 4/233, 661, 4/229

See application file for complete search history.

(56) References Cited

U.S. PATENT DOCUMENTS

| | | | | |
|---|---|---|---|---|
| 2,320,156 | A * | 5/1943 | Perlmutter | 4/233 |
| 4,193,144 | A * | 3/1980 | McNally | 4/229 |
| 4,242,764 | A * | 1/1981 | Fukuda | 4/420.4 |
| 4,790,039 | A * | 12/1988 | Speer | 4/233 |
| 5,842,609 | A * | 12/1998 | Higgins et al. | 222/181.3 |
| 2005/0229300 | A1 * | 10/2005 | Wilcox | 4/420.4 |

* cited by examiner

*Primary Examiner* — Dinh Nguyen
(74) *Attorney, Agent, or Firm* — Charles I. Brodsky

(57) ABSTRACT

A dispenser discharging antibacterial, self-drying disinfectant solution is suspended from an inside wall of a public rest facility stall to transport the solution through a length of tubing to an inlet port at a rear or side surface of a non-porous and non-absorbent toilet seat in filling a hollow therein below an opening in the top surface of the seat in introducing the disinfectant solution to be spread about the top surface in cleansing it of any generally sexually transmitted germs, viruses and bacteria that might be present.

9 Claims, 2 Drawing Sheets

PUBLIC RESTROOM TOILET SEAT SANITIZING APPARATUS

CROSS-REFERENCE TO RELATED APPLICATIONS

This Application is a Continuation-in-Part of application Ser. No. 11/030,225 filed Jan. 7, 2005 now abandoned.

STATEMENT REGARDING FEDERALLY SPONSORED RESEARCH OR DEVELOPMENT

Research and development of this invention and Application have not been federally sponsored, and no rights are given under any Federal program.

REFERENCE TO A MICROFICHE APPENDIX

Not applicable

BACKGROUND OF THE INVENTION

1. Field of the Invention

This invention relates to public restroom toilets and, more particularly, to apparatus for sanitizing and cleansing the toilet seats within of generally sexually transmitted germs, virus and bacteria.

2. Description of the Related Arts

It is not uncommon for people to use public restroom toilets as may be found in restaurants, at transportation terminals, and in such public places as theaters, museums, casinos, places of business and other places where the public is invited. With modern technology, such facilities also take the form of such portable units as might be found at a fairground, sporting event, or parade, for example.

As is well understood, many people in need of using such facilities hesitate to do so because of the fear that the sitting on the toilet seat might result in the catching of generally sexually transmitted diseases, resulting from germs, virus and bacteria left on the seat by previous occupants. In those circumstances where the toilet seat is nevertheless used, many of the attending public first attempt to cover the seat with toilet paper, while others first rinse the toilet paper in an adjacent sink before washing down the seat. One problem with this first method is that the configuration of the seat does not readily lend itself to retain the paper in position prior to its being sat upon—a second problem being that the paper oftentimes clings to the underside of the user's thighs upon getting up. With the second manner of attempting to clean the seat before use, a source of rinse water is not always available —as, where the stall is of a "portable-potty" type transported to a field location in handling an over-flow crowd, and thereafter removed for storage. An alternative approach of pulling a paper seat cover down from an adjacent cabinet and placing it onto the seat suffers from the disadvantage that not all toilet seat configurations are configured the same, so that no universal shape for the pull-down paper cover is available for convenient placement on the seat then to be utilized. Also, as will be appreciated, others try to refrain from using the public toilet seat because of difficulty in squatting over a strange seat in use that they would prefer not to be using. Even though these problems continue to persist, those in need continue to utilize the public rest facility—although a preferable way of dealing with the toilet seat would obviously much be welcomed.

OBJECTS OF THE INVENTION

It is an object of the present invention, therefore, to provide a new and improved public restroom toilet seat sanitizing apparatus.

It is an object of the invention, also, to provide such an apparatus which is located at the restroom facility itself, so that it will always be there, and not require a user to carry anything about with them on their person, as in a pocket book or wallet, to clean a toilet seat when the occasion arises for its needed use.

It is another object of the invention to provide such sanitizing apparatus as will be available for use whenever, and wherever, it is needed.

It is a further object of the present invention to provide such a public restroom toilet seat sanitizing apparatus useful in cleansing a toilet seat of generally sexually transmitted germs, virus and bacteria whether or not a source of rinse water is available.

SUMMARY OF THE INVENTION

As will become clear from the following description, the apparatus of the present invention operates upon a toilet seat on a commode within a walled-in stall of a public rest facility, with the toilet seat being non-porous and non-absorbent throughout, and having top, bottom, rear and side surfaces with a hollow between the top and bottom surfaces. An inlet port is provided on one of the rear and side surfaces of the non-porous and non-absorbent seat, communicating inwardly with the hollow —and an opening is provided in the top surface of the seat overlying such hollow. In accordance with the invention, a dispenser containing an antibacterial, self-drying disinfectant solution is suspended from an inside wall of the stall, and a length of tubing extends between an outlet port of the dispenser and the inlet port of the seat. Means are provided for actuating the dispenser to discharge its disinfectant solution from the dispenser through the tubing, the inlet port of the seat and the hollow, to exit onto the top surface of the seat by way of the opening there provided, in allowing the disinfectant solution to be swabbed by a user to clean the seat of any generally sexually transmitted germs, viruses and bacteria that might be there. As will be appreciated, the disinfectant solution may simply be spread about the seat through the use of toilet paper, or any such similar paper present.

In a preferred construction of the invention, the length of tubing may be of a plastic or stainless steel composition, and of substantially ¼ inch outside diameter. The tubing may be joined with the inlet port on the toilet seat by a compression fitted coupler—for example, of a ¼ inch inside diameter by a ¼ inch National Pipe Thread (NPT) male threaded compression 90° fitting. Such coupler may likewise be of stainless steel composition, or of brass or plastic for that matter. To assure economy of operation, the actuation of the dispenser to discharge its disinfectant solution may be by way of a paddle responsive to an applied hand pressure in allowing a measured amount of disinfectant solution to be discharged on each push of the paddle.

In a first embodiment, the sanitizing apparatus of the invention is incorporated in a toilet seat of rounded configuration to seat on a rounded bowl of a commode. In a second embodiment, the toilet seat is of elongated configuration to seat on an elongated bowl.

BRIEF DESCRIPTION OF THE DRAWING

These and other features of the present invention will be more clearly understood from a consideration of the following description, taken in connection with the accompanying drawing in which.

DETAILED DESCRIPTION OF THE INVENTION

Figure 1A:
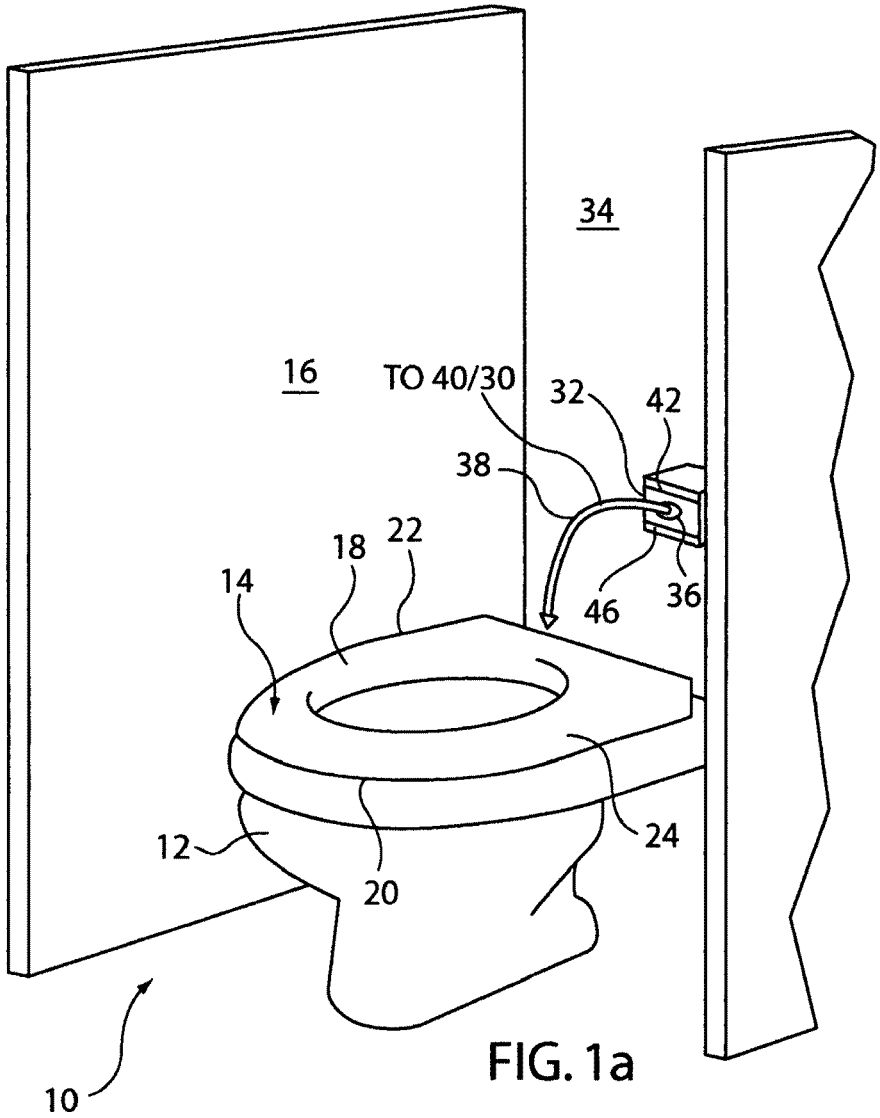
FIGS. 1*a* and 1*b* are helpful in an understanding of the sanitizing apparatus of the invention as incorporated in a rounded toilet seat configuration.
Figure 1B:
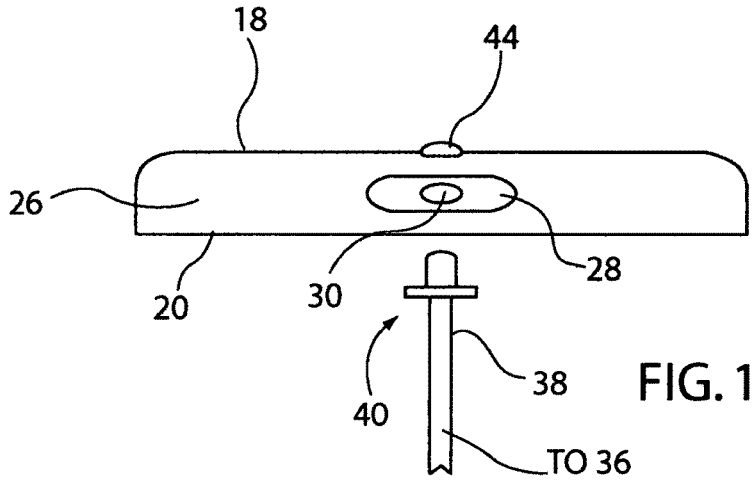

In FIGS. 1*a* and 1*b*, a toilet 10 includes a rounded bowl commode 12 and a rounded seat 14 within a walled-in stall 16 of a public rest facility, the seat being of a non-porous and non-absorbent material throughout. As indicated, the rounded seat 14 is configured by its top and bottom surface 18, 20, side surfaces 22 and 24 and a rear surface 26. In accordance with the invention, a hollow 28 is provided within the seat 14, between its top and bottom surfaces 18, 20, and an inlet port 30 on the rear surface 26 communicates inwardly with the hollow 28 (although with the teachings of the invention, such inlet port 26 may be located instead on one of the side surfaces 22, 24).

A dispenser 32 containing an antibacterial, self-drying disinfectant solution is suspended from an inside wall of the stall 16 (as at 34)—and includes an outlet port 36 to which is coupled a length of tubing 38 which extends to reach the inlet port 30 of the seat 14. Such tubing 38 joins with the inlet port 30 (and thereby with the hollow 28) by way of a compression fitted coupler 40. To such end, the inlet port 30 on the non-porous, non-absorbent rounded seat 14 may be threaded internally, to receive the coupler 40—which may be of ¼ inch inside diameter by ¼ inch NPT male thread compression 90° for a length of tubing 38 of substantially ¼ outside diameter. Such coupler 40 may be one of a brass or stainless steel composition, while the tubing 38 may be of plastic or stainless steel composition at the same time. To insure a permanent type, secure coupling, the inlet port 30 on the seat 14 may be an NPT female thread.

Figure 2:
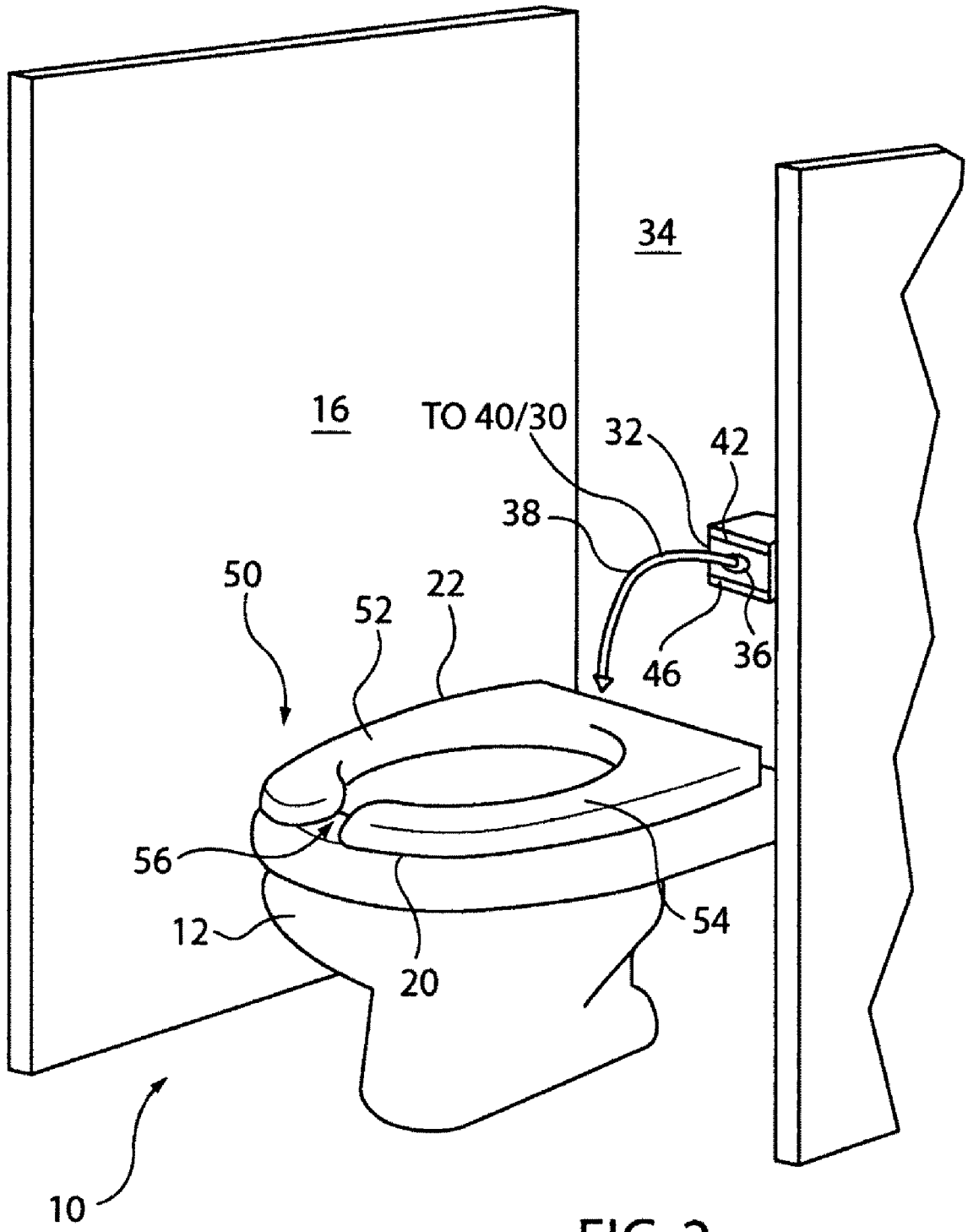
FIG. 2 is helpful in an understanding of the apparatus as incorporated in an elongated toilet seat configuration.

In the second embodiment of FIG. 2, the rounded seat 14 of FIGS. 1*a* and 1*b* is replaced by an elongated non-porous and non-absorbent toilet seat 50 for seating on an elongated bowl commode. As indicated, the elongated seat 50 is formed of two oppositely facing disjointed sections 52, 54 forming an open space separation 56 at the front in providing an open-front seat. With the other components of the sanitizing apparatus remaining and operating the same, this embodiment of the invention is especially suited for recent pronouncements of the National Standard Plumbing Code of the Plumbing-Heating-Cooling Contractors National Association that water closets for public use be provided with elongated bowl commodes with open-front elongated seats. The teachings of the invention will be understood to provide advantages for both these elongated bowl commodes as well as for the earlier rounded designs.

As will be readily apparent to those skilled in the art, the antibacterial, self-drying disinfectant solution may be of any appropriate type, but one which would be effective in cleaning the seat of any generally sexually transmitted germs, viruses and bacteria that might be present. To permit refilling, the dispenser 32 may be provided with a removable top 42 to allow filling, preferably to a 1-2 gallon capacity—or by any other appropriate manner. When of a composition comparable to that of a "hand-soap" found in public restroom facilities for washing one's hands at a sink, a like disinfectant solution could be used in the dispenser 32, in allowing the solution to be spread about the top surface 18 of the non-porous, non-absorbent seat by toilet paper. To obtain the disinfectant on the top surface 18, a further opening 44 is provided in the surface 18 so that the disinfectant solution once discharged, is able to flow through the outlet port 36 of the dispenser 32, the tubing 38, the coupler 40 into the hollow 28 and out the opening 44 located to overlie the hollow 28. Such dispenser 32 may be of a type having a "paddle" 46 responsive to an applied hand pressure pressing on it to discharge a measured amount of disinfectant solution with each "push" in transporting the disinfectant solution from the dispenser 32 to the opening 44, to be thereafter spread about.

As will thus be seen, the advantages of the invention also would be attractive in eliminating the need for "pull down" paper dispensing seat configurations at a public restroom location or the requirement for continually servicing them.

While there have been described what is considered to be a preferred embodiments of the present invention, it will be readily appreciated that modifications can be made without departing from the scope of the teachings herein. Specifically, the toilet seat of the invention is constructed of a non-porous and non-absorbent material throughout as mandated by the National Standard Plumbing Code for water closets as required in public restroom facilities and toilets where the teachings of the invention are to be used. This porous vs. non-porous difference is understandable thusly: With a porous, absorbent toilet seat material, any urine striking it, and germs, virus or bacteria left on it, will be absorbed. That is typically not thought of or considered when the toilet's user is the sole occupant of the home or an immediate family member. One simply does not wipe the toilet seat in his/her home each time before it is used, or after each prior use by an immediate family member. But it is almost always done when using a strange toilet in a public restroom facility—such as in an office building or restaurant.

With the non-porous, non-absorbent toilet seats mandated for public water closet use, on the other hand, the urine, germs, viruses, bacteria are not absorbed by he toilet seat of the invention, but stay on the top surface of the toilet seat. The sanitizing operation of the invention can then effectively be carried out, as described above.

For at least such reason, therefore, resort should be had to the claims appended hereto for a true understanding of the scope of the invention.

I claim:

1. The combination comprising:

a toilet seat on a commode within a walled-in stall of a public restroom facility, said commode having an elongated bowl, said seat having an open front and an elongated configuration fitting the elongated bowl, said toilet seat being non-porous and non-absorbent throughout, and said seat having a hollow between top and bottom surfaces thereof;

a dispenser containing an antibacterial, self-drying disinfectant solution suspended from an inside wall of said stall;

an inlet port on one of rear and side surfaces of said, seat communicating inwardly with said hollow;

a length of tubing extending between an outlet port of said dispenser and said inlet port on said seat;

an opening in said top surface of said seat overlying said hollow; and a push-paddle responsive to a user's applied hand pressure pressing thereon for actuating said dispenser to discharge a measured amount of said disinfectant solution from said dispenser on each actuation by the user through said tubing, into said inlet port on said seat and through said hollow of said seat to exit onto said top surface of said non-porous and non-absorbent seat via said opening in said top surface;

wherein said disinfectant solution is discharged to sanitize said top surface of said seat of generally sexually transmitted germs, viruses and bacteria via a wiping thereabout by the user thereof.

2. The combination of claim 1 wherein said length of tubing is one of a plastic and stainless steel composition.

3. The combination of claim 2 wherein said length of tubing is of substantially ¼inch outside diameter.

4. The combination of claim 1, including a compression-fitted coupler between said inlet port and said length of tubing.

5. The combination of claim 4 wherein said inlet port is an NPT female thread.

6. The combination of claim 5 wherein said coupler is a ¼inch inside diameter by ¼inch NPT male thread compression 90°.

7. The combination of claim 6 wherein said coupler is one of a brass, plastic and stainless steel composition.

8. The combination of claim 1 wherein said dispenser includes a removable top for filling said dispenser to a 1-2 gallon capacity.

9. The combination of claim 1 wherein said toilet seat is of a configuration providing said open-front seat of elongated configuration by having two oppositely facing disjointed sections forming an open space separate at front portions thereof.

* * * * *